US005715602A

United States Patent [19]

Hage

[11] Patent Number: 5,715,602

[45] Date of Patent: Feb. 10, 1998

[54] CIGAR TIP CUTTER

[76] Inventor: Stephen J. Hage, 22115 Halsted St., Chatsworth, Calif. 91311

[21] Appl. No.: 755,111

[22] Filed: Nov. 22, 1996

[51] Int. Cl.[6] ..... A24C 5/12

[52] U.S. Cl. ..... 30/113; 30/111

[58] Field of Search ..... 30/109, 111, 113; 131/248, 250, 252, 253

[56] References Cited

U.S. PATENT DOCUMENTS

| | | | |
|---|---|---|---|
| Re. 13,873 | 2/1915 | Emrich | 30/113 |
| 715,315 | 12/1902 | Steinecke | 30/113 |
| 837,018 | 11/1906 | Wentz | 30/113 |
| 953,313 | 3/1910 | Astruck et al. | 30/113 |
| 958,610 | 5/1910 | Emrich | 30/111 |
| 1,082,257 | 12/1913 | Astruck | 30/113 |
| 1,119,220 | 12/1914 | Bates | 30/113 |
| 1,166,881 | 1/1916 | Anderson | 30/113 |

FOREIGN PATENT DOCUMENTS

| | | | |
|---|---|---|---|
| 622328 | 3/1933 | Germany | 30/111 |
| 20455 | of 1909 | United Kingdom . | |

*Primary Examiner*—Hwei-Siu Payer
*Attorney, Agent, or Firm*—Bacon & Thomas

[57] ABSTRACT

An cigar tip cutter having a plastic housing defining an internal cavity for receiving relatively slidable cutting blades includes a cigar tip receiving opening that cooperates with the cutting blades for cutting a cigar tip placed in the opening of the housing. Relative motion of the blades causes registration of the cutting edges of the blades with the cigar tip receiving opening and motion of the blades towards each other effects severing of the cigar tip. Plastic guide rails fit in plastic grooves within the housing to guide the motion of the blades and prevent separation of the blades from the plastic housing. The plastic guide rails and cooperating plastic grooves include a position holding feature that functions as a friction lock when the blades are in the collapsed position within the housing.

12 Claims, 2 Drawing Sheets

CIGAR TIP CUTTER

BACKGROUND OF THE INVENTION a) Field of the Invention

The present invention is directed to a cigar tip cutter.

b) Discussion of Related Art

In view of the recent new interest and popularity of smoking cigars, the art of cutting the ends of cigars has again aroused the attention of smokers. Various mechanisms were provided back in the early days of the twentieth century for cutting tips of cigars to enhance the smokers' enjoyment for smoking cigars. Some early cigar cutters were always made of metal in which a single metal blade was provided, such as seen in U.S. Pat. Nos. 837,018 and 1,166,881. Others, including U.S. Pat. No. 715,315 and the two patents to Emrich, U.S. Pat. No. 958,610 and RE 13,873, had two metal blades moving past each other to cut the end of a cigar inserted between the two blades. All of these prior constructions were made of metal with metal blades and housings, and constructed so that the metal parts slid back and forth on one another, causing wearing of the metal parts on each other. British Application No. 20,455 also shows an example of two metal blades sliding past each other to cut the cigar end.

Recently, because of the advent of plastics materials, cigar cutters have been constructed with metal blades sliding within plastic bodies which form the outer body of the cigar cutter. Here, an even more prevalent problem of wearing of one part against another occurs, ie. the sliding and impacting of metal against plastic. This causes significant wearing by cutting and abrasion of the plastic parts by the metal blades in the cigar cutter which leads to an early end to its useful life. Also and more importantly, not only is the sliding and impacting of the metal part over and against the plastic a problem in the destruction of the plastic, but the use of plastic stops and detents in the structure to limit the length of movement of the metal blade leads to a further significant problem, ie. the destroying of such plastic stops and detents by the metal of the blade material.

This mixing of the earlier techniques with modem materials results in problems for constructing reliable, long lasting cigar cutters that are overcome by the present invention.

SUMMARY OF THE INVENTION

The present invention is directed to an improved structure of a cigar tip cutter using modem plastic materials to house metal cutters to form a long lasting, highly durable cutter assembly that can be used for a significantly long time.

In particular, the present invention is directed to an improved cigar cutting structure which relies on plastic parts sliding over or against other plastic parts in order to relieve the past problems of mixing old structures and construction with modem materials.

The cigar cutter of the present invention involves the use of plastic guide rails fixed to metal blades which guide the motion of the blades and limit the motion of the blades relative to a plastic housing. This significantly increases the life time of use of the cigar cutter of the present invention by avoiding metal sliding against or striking plastic for guiding or limiting blade motion.

In the assembly of the present invention, the plastic rails are mounted on or fixed to the sides of respective metal blades and the movement of the blades relative to each other causes these plastic mils to move back and forth within grooves in the plastic housing, thereby resulting in plastic moving on and against plastic.

Moreover, friction locks or stops are formed with respect to the plastic rails by way of plastic tips or protrusions mating with corresponding notches or detents in the plastic groove structures of the plastic housing, thereby providing a position holding arrangement within the housing by plastic parts engaging plastic parts. The tips may be on the plastic rails and the corresponding detents in the groove structures, or the tips may be on the groove structures and the detents in the plastic rails.

The protrusions and corresponding detents are matched so that the cigar cutter blades are maintained in a collapsed position in the housing when not in use, but the blades of the cigar cutter can be extended with ease by the fingers of one hand to an open position for positioning the blades in a cutting relationship relative to the housing. The housing of the cigar cutter is provided with the usual cigar tip receiving opening and the cutter blades each include cooperating cutting edges that can be moved into registration with the housing opening in preparation for cutting the tip of a cigar that is insertable through the opening. Upon collapsing of the blades relative to each other within the housing cavity, the cutting edges server the tip of the cigar in the usual manner. A handle arrangement is provided on each blade for manipulating the blade between its collapsed and extended positions.

BRIEF DESCRIPTION OF THE DRAWING FIGURES

The present invention may be understood by reference to the drawing figures which, without limitation the features of the invention illustrate:

DETAILED DESCRIPTION OF THE PREFERRED EMBODIMENT OF INVENTION

Figure 1:
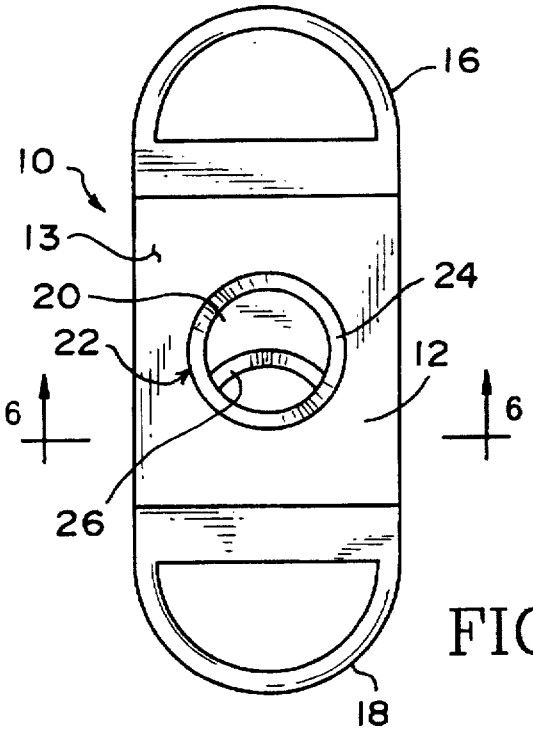
FIG. 1 is a plan view showing the assembled cigar cutter of this invention.
Figure 6:
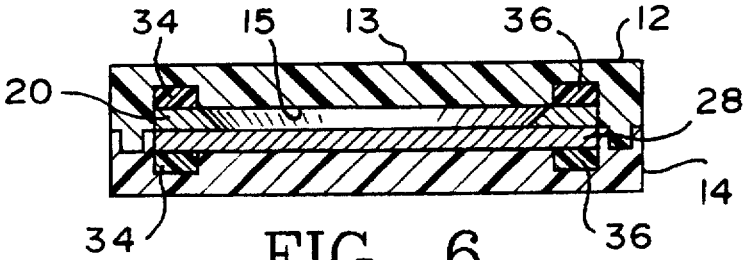
FIG. 6 shows a cross-sectional view of the assembled cigar cutter taken through lines 6—6 of FIG. 1.
Figure 7:
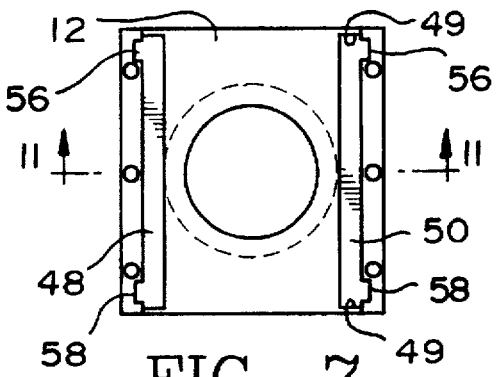
FIG. 7 is a plan view of one half of the plastic housing of the assembled cutter as shown in FIG. 1.
Figure 8:
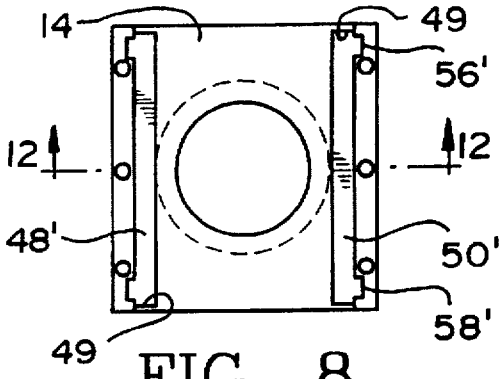
FIG. 8 is a plan view of the other half of the plastic housing shown in FIG 1.
Figure 9:
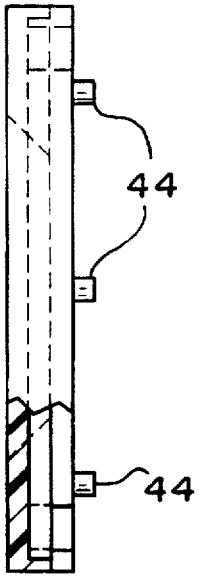
FIG. 9 is a partial cross-section view of the plastic housing half shown in FIG. 7 as seen from one side.
Figure 10:
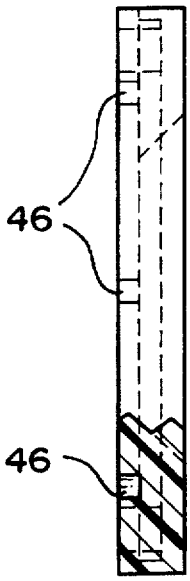
FIG. 10 is a partial cross-sectional view of the plastic housing half shown in FIG. 8 as seen from one side.
Figure 11:
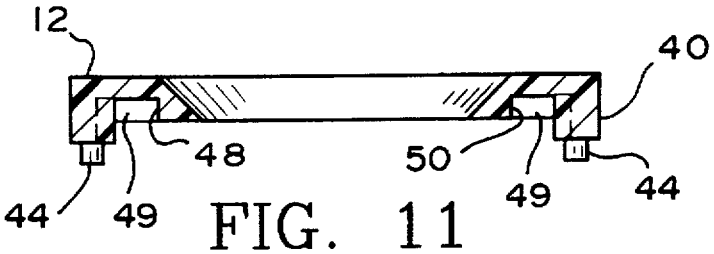
FIG. 11 is a cross-sectional view of the half of the plastic housing shown in FIG. 7 taken through the line 11—11.
Figure 12:
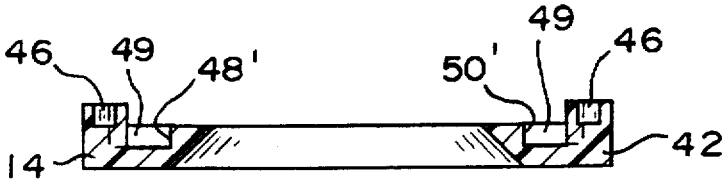
FIG. 12 is a cross-sectional view of the other half of the plastic housing shown in FIG. 8 taken through the line 12—12.

The cigar tip cutter in accordance with the present invention is illustrated in the attached drawing figures wherein, in FIGS. 1 and 6, cigar tip cutter 10 includes mating plastic body halves 12, 14 permanently joined together to define a housing 13 and being configured on their interior surfaces so as to define a central cavity 15 within which is located identical metal cutting blades 20, 28 arranged to reciprocally slide relative to each other and the housing inwardly and outwardly between collapsed and extended positions. The plastic housing 13 includes generally central cigar tip receiving openings 22 on opposed sides that intersect the surfaces of the housing along beveled edges 24. Both sides of the housing 10 are similar to the upper view shown in FIG. 1.

Figure 2:
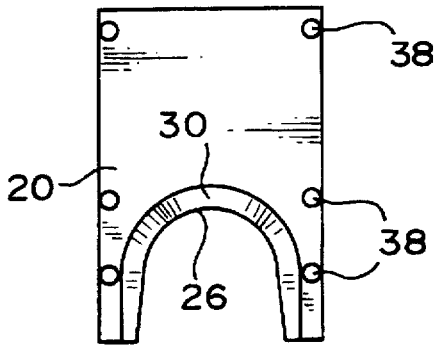
FIG. 2 shows a detail plan view of a metal blade used in the cutter.
Figure 3:
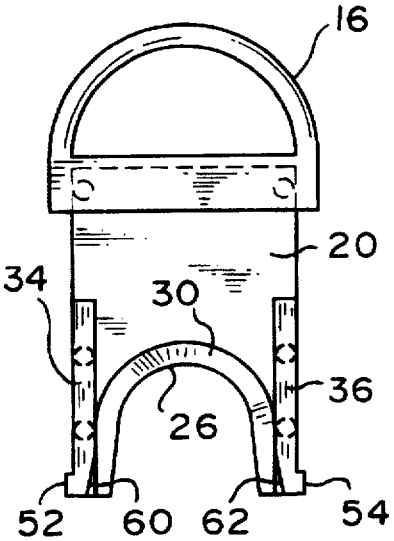
FIG. 3 is a plan view of a single blade assembly of the present invention as seen with a blade according to FIG. 2.
Figure 4:
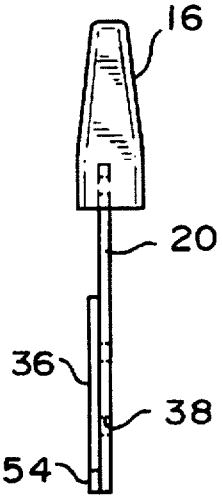
FIG. 4 is a side view of the blade assembly of FIG. 3.

The blades 20, 28 are identical and, as illustrated in FIGS. 2–4, include a metal blade portion 20, curved cutting edges 26 joined by a bevel 30 to the body of the metal blade and apertures 38 extending along each side of the blade. The cutting edges 26, of course, could have any desired shape that will effect cutting of a cigar tip in the housing 13.

Each blade 20, 28 includes a handle 16 at its proximal end for manipulating the blade outside of the housing 10, with the cutting edge 26 being located adjacent the opposite or distal end of the blade. The cutting edges 26 of the blades 20, 28 can be registered with the opening 22 in the housing 12 to enable a cigar tip to be inserted through an opening 22 and in the space between the cutting edges 26 of the blades 20, 28. Sliding the blades into the collapsed position as shown in FIG. 1 effects cutting of the tip of a cigar inserted in the opening 22 of the housing 12.

The plastic of the plastic body halves 12, 14, as well as all of the plastic parts in the present invention, preferable may be formed of an ABS type plastic. In addition, however, the plastic may be a high impact polystyrene, a nylon body, a plastic material having the designation of Delrin, or any other type of plastic having a hardness suitable for the housing and parts.

Figure 5:
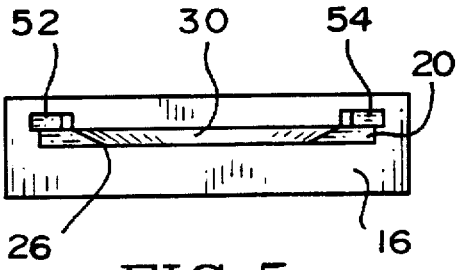
FIG. 5 is an end view of blade assembly shown in FIG. 3.

A pair of plastic guide rails 34 and 36 are mounted on each side of each cutting blade 20 or 28, as may be seen, for example, in FIGS. 3, 4 and 5. These plastic parts of the cutting blades may be mounted to the metal blade by any fastening technique, such as preferably by a molding technique whereby plastic in a mold with the blade will flow through openings 38 in the blade and solidify, thereby locking the metal blades 20 and 28 to the respective plastic handles 16 and 18 and respective plastic rails 34 and 36 at each side of the blades 20 and 28. The two such metal blades 20 and 28 are formed in the same manner. Alternatively, the plastic handles and rails may be secured to the two metal blades by any fastening means, such as by glue or various mechanical means, such as by use of rivets or screws.

The metal of the blades is preferably of a stainless steel material to maintain its durability, and may be, for example, 440H Stainless Steel hardened to 45 Rockwell. Other types of metal materials useful for cutting surfaces may be used, but the maintenance of non-rusting surfaces is a primary requirement.

Each housing half 12, 14 of the cigar cutter 10 includes elevated side portions 40, 42 extending along each side of the half to thereby define a blade receiving cavity 15 between the housing halves when they are secured together. Pins 44 and apertures 46 are preferably provided on respective halves of the housing to enable the halves to be permanently joined together, such as by ultrasonic welding, adhesive or any other fastening arrangement known to those skilled in the art. When joined, the housing halves 12, 14 provide slots for receiving metal blades 20, 28 at each end thereof and an internal cavity 15 for receiving the blades in contiguous and close fitting (relative to the cavity) relationship.

Each housing half 12, 14 also includes guide rail receiving grooves 48, 50 and 48', 50', respectively. Each groove includes an abutment 49 for limiting the sliding motion of the blades 20, 28 relative to each other and relative to the housing halves 12, 14 by interfering with the motion of the rails 34, 36.

The cigar cutter 10 is assembled by first placing a cutter blade 20, 28 within its respective housing half 12, 14 with the guide rails 34, 36 located in the grooves 48, 50 and 48', 50' and with the handle 16 located exteriorly of the housing halves. The housing halves are then brought together so that the pins 44, and apertures 46 engage each other and the housing halves are then permanently joined to each other with the blades 20, 28 contained within the cavity 15 in contiguous relationship for reciprocal sliding motion relative to the housing halves 12, 14. It will be seen that the plastic guide mils 34, 36 guide the motion of the blades 20, 28 relative to each other and relative to the housing halves 12, 14 while abutments 49 prevent separation of the blades from the housing defined by the housing halves 12, 14.

Thus, the guiding of the blades 20, 28 within the housing 13 defined by the halves 12, 14 occurs as a result of plastic elements (guide rails) sliding within plastic guide receiving grooves and the motion of the blades is limited in the expanded direction by interference between the ends of the plastic guide rails 34, 36 and the abutments 49. This avoids guiding the metal blades by means of metal rubbing against plastic and also avoids limiting the motion of the blades relative to the plastic housing halves by means of metal impacting against plastic. Instead, these functions are performed by plastic rubbing against or impacting against plastic.

To provide a friction lock to retain the blades 20, 28 in a retracted or collapsed position as shown in FIG. 1, a friction lock for releasably holding the position of the blades in a retracted position includes laterally extending protuberances 52, 54 on the distal ends of the guide rails 34, 36 (see FIG. 3) that cooperate with laterally extending detent notches 56, 58 and 56', 58' associated with the grooves 48, 50 and 48', 50'. The guide rails 34, 36 are elastically deformable in the vicinity of protuberances 52, 54 by bevelling or reducing the cross sectional area of the guide rails adjacent the protuberances 52, 54 as shown at 60, 62.

When the blades 20, 28 are inserted in their respective housing halves 12, 14, the protuberances 52, 54 may be placed in respective notches 56, 58 or 56', 58'with the material of the guide mils 34, 36 in relaxed positions as shown in FIG. 3. However, the protuberances are small, for example on the order of about 0.01 to 0.02 inches (0.3–0.5 mm) in height, so that upon movement of the blades, 28 relative to the each other and relative to the housing halves 12, 14 in an extended direction away from each other, the protuberances 52, 54 will slip out of their respective notch detents by the elastic deformation of the rails 34, 36 in the immediate area of the protuberances. Thus, a simple but effective position holding device is provided for the respective blades. It will be seen that the notches 56, 58, and 56', 58' constitute holder features within the cavity 15 for cooperating with the position holding devices defined by the protuberances 52, 54. The protuberances also slide against the edges of the guide grooves to provide a slight friction resistance to blade motions when they are located outside the detent notches.

The cigar tip cutter made according to the present invention may be of a small size, ie. about three and three quarter inches by one and a half inches in the closed position with a relatively small corresponding thickness, so that it may easily fit into one of a person's pockets. The tip cutting opening may have a beveled opening of about three quarters of an inch in diameter to accommodate most, if not all, cigars for cutting.

While a specific embodiment of the present invention has been described and shown, numerous options and variations that will be apparent to the person skilled in the related art may be incorporated into the inventive structure and technique without departing from the invention. All such options and variations in structure and technique are considered a part of the present invention and the invention is not to be limited by the specific embodiment described herein but only to the extent provided in the following claims.

What is claimed is:

1. A cigar tip cutter comprising:

a plastic housing having a cigar tip receiving opening and an interior cavity;

a pair of cooperating metal cutting blades mounted in said cavity for relative sliding movement with respect to each other and said cavity, said blades including cooperating cutting edges registrable with said cigar tip receiving opening;

at least one plastic guide element on each of said blades arranged to cooperate with the housing to guide the motion of said blades in the cavity;

motion limiting devices in the cavity arranged to cooperate with each said guide element to restrict motion of the guide elements and the blades relative to the housing for preventing separation of the blades from the housing;

a releasable position holding device associated with each said guide element, said holding device arranged to engage a holder feature in said cavity to releasably hold each of said blades against relative motion within the housing at least when the blades are located at one position within the housing;

guide grooves in the cavity;

each said blade having a proximal end and a handle attached thereto located outside of the cavity and a distal end inside the cavity;

said cutting edges being disposed adjacent the blade distal ends;

each said plastic guide element comprising an elongated rail element extending in a direction parallel to reciprocal motion of the respective blade on which the guide element is provided and slidably fitting in one of said guide grooves;

each said position holding device and each said holder feature comprising a plastic protuberance and a detent notch that are both geometrically configured to cooperate with each other to effect a friction lock between said protuberance and said holder feature when they are moved into registration with each other by movement of an associated blade;

each said protuberance being located on each said rail element and extending generally transversely of the direction of reciprocal motion of the blade on which the guide element is provided; and each said holding feature comprising a detent notch in one of said guide grooves engageable by said protuberance to effect said friction lock.

2. A cigar tip cutter according to claim 1, said rails arranged to elastically deform to permit disengagement movement of said protuberances relative to said holder features upon motion of said protuberances away from said holder features when said friction lock is overcome during motion of said blade relative to said housing.

3. A cigar tip cutter according to claim 1, wherein said detent notches are located at opposed ends of said guide grooves and said protuberances are located adjacent the distal ends of said cutting blades.

4. A cigar tip cutter comprising:

(a) a plastic housing having a cigar tip receiving opening and an interior cavity;

(b) a pair of cooperating metal cutting blades mounted in said cavity for relative sliding movement with respect to each other and said cavity, said blades including cooperating cutting edges registrable with said cigar tip receiving opening;

(c) at least one plastic guide element on each of said blades arranged to cooperate with the housing to guide the motion of each said blade in the cavity; and (d) motion limiting devices in the cavity arranged to cooperate with each said guide element to restrict motion of the guide elements and the blades relative to the housing for preventing separation of the blades from the housing.

5. A cigar tip cutter according to claim 4, wherein said blades are mounted in the cavity for relative reciprocal motion;

each said blade has a proximal end and a handle secured to the proximal end located outside of the cavity and a distal end inside the cavity;

said cutting edges disposed adjacent the blade distal ends;

guide grooves in the housing cavity;

said plastic guide elements arranged to slidably fit in said guide grooves.

6. A cigar tip cutter according to claim 5, said plastic guide elements comprising elongated guide rail elements extending parallel to the direction of reciprocal motion of said blades.

7. A cigar tip cutter according to claim 5, wherein said motion limiting devices comprise motion limiting abutments in said guide grooves arranged to stop the reciprocal motion of the guide elements and the blades to prevent separation of the blades from the housing.

8. A cigar tip cutter according to claim 5, wherein said guide grooves are integrally molded in the housing adjacent said cavity.

9. A cigar tip cutter according to claim 4, including a releasable position holding device associated with each said guide element, said holding device arranged to engage a holder feature in said cavity to releasably hold each said blade against relative motion within the housing at least when the blades are located at one position within the housing.

10. A cigar tip cutter according to claim 9, wherein each said position holding device and each said holder feature comprise a plastic protuberance and a detent notch that are both geometrically configured to cooperate with each other to effect a friction lock between said protuberance and said holder feature when they are moved into registration with each other by movement of its associated cutting blade.

11. A cigar tip cutter according to claim 4, said housing being formed of two permanently joined mating halves, with each said half including a structural feature defining substantially one-half said cavity;

said blades arranged to slide against each other in close fitting relationship with the walls deeming said cavity when moved relative to each other;

said blades arranged to reciprocate linearly relative to each other and said housing; and each said blade including a handle device connected to the blade and located outside the housing for manipulating the blade connected to the respective handle device externally of the cavity.

12. A cigar tip cutter according to claim 11, wherein said motion limiting devices comprise integrally molded portions of said plastic housing adjacent said cavity.

* * * * *